US008303203B2

(12) United States Patent
Bahash

(10) Patent No.: US 8,303,203 B2
(45) Date of Patent: Nov. 6, 2012

(54) SOAP BAR OR SUBSTANCE APPLICATION BAR

(75) Inventor: Timothy J. Bahash, Philadelphia, PA (US)

(73) Assignee: 4mula, Inc., Philadelphia, PA (US)

( * ) Notice: Subject to any disclaimer, the term of this patent is extended or adjusted under 35 U.S.C. 154(b) by 904 days.

(21) Appl. No.: 10/737,920

(22) Filed: Dec. 18, 2003

(65) Prior Publication Data

US 2005/0133385 A1 Jun. 23, 2005

(51) Int. Cl.
*A45D 40/20* (2006.01)

(52) U.S. Cl. ..... 401/88; 401/49; 510/148

(58) Field of Classification Search ..... 401/19, 401/48, 88, 131, 201, 49; 206/77.1; D6/536; 510/117, 140, 148, 192, 440, 449
See application file for complete search history.

(56) References Cited

U.S. PATENT DOCUMENTS

| | | | | | |
|---|---|---|---|---|---|
| 3,925,225 | A | * | 12/1975 | Morrison | 510/148 |
| 3,931,035 | A | | 1/1976 | Brown | 252/134 |
| 4,050,825 | A | * | 9/1977 | Stein | 401/19 |
| 4,081,394 | A | | 3/1978 | Bartley | 252/91 |
| 4,256,599 | A | * | 3/1981 | Krisp et al. | 510/117 |
| 4,265,778 | A | | 5/1981 | Sonenstein | 252/117 |
| 4,311,604 | A | | 1/1982 | Hörnig | 252/90 |
| 4,313,537 | A | | 2/1982 | Collet | 206/77.1 |
| 4,335,007 | A | | 6/1982 | Owens | 252/92 |
| 4,391,427 | A | | 7/1983 | Foresman | 248/176 |
| 4,402,848 | A | | 9/1983 | Brewer | 252/134 |
| 4,460,490 | A | * | 7/1984 | Barford et al. | 510/192 |
| 4,618,443 | A | | 10/1986 | Jude | 252/92 |
| 4,741,852 | A | | 5/1988 | Ondracek | 252/92 |
| 4,820,438 | A | | 4/1989 | Zilch | 252/108 |
| 4,877,674 | A | | 10/1989 | Kappes | 428/192 |
| 4,885,108 | A | | 12/1989 | Richter | 252/134 |
| 4,965,008 | A | * | 10/1990 | Chang | 510/449 |
| 5,022,517 | A | | 6/1991 | Benitez | 206/77.1 |
| 5,071,583 | A | | 12/1991 | Martell | 252/92 |
| 5,198,140 | A | * | 3/1993 | Joshi et al. | 510/440 |
| 5,221,506 | A | | 6/1993 | Dulin | 252/92 |

(Continued)

FOREIGN PATENT DOCUMENTS

JP 2002363600 A * 12/2002

OTHER PUBLICATIONS

Mike Hulbert, "Crafting Soap at Home," 1998, pp. 11-13, 15-23, 25-30, 33-39, 41, 43-52, 54-55, 57-61, 63-67.

(Continued)

*Primary Examiner* — Tuan N Nguyen
(74) *Attorney, Agent, or Firm* — Winston & Strawn LLP

(57) ABSTRACT

The substance application bar includes an application portion having an exterior surface and an interior surface and configured for applying a substance to a receiving surface and at least one blocking extension extending adjacent the interior surface of the application portion to define a retaining recess therebetween. The blocking extension and the interior surface are associated to cooperatively substantially block movement of an object received in the retaining recess in a direction generally along the interior surface against the blocking extension. The substance application bar may also include at least one bar-preserving extension associated with the interior surface to maintain a portion of the recess open to the atmosphere. This facilitates air flow through and drying of the recess for resisting deterioration of the bar. An assembly of application bars in stacked association also is included.

28 Claims, 11 Drawing Sheets

U.S. PATENT DOCUMENTS

| | | | | | |
|---|---|---|---|---|---|
| 5,250,210 | A | | 10/1993 | Von Culin | 252/90 |
| 5,390,971 | A | | 2/1995 | Warren | 294/25 |
| 5,509,529 | A | | 4/1996 | Kelley | 206/77.1 |
| 5,834,410 | A | * | 11/1998 | Slocum | 510/140 |
| 5,941,376 | A | | 8/1999 | Liggett | 206/77.1 |
| 5,952,276 | A | | 9/1999 | de Ferran et al. | 510/141 |
| 5,984,440 | A | | 11/1999 | Watson | 312/206 |
| 6,242,399 | B1 | | 6/2001 | Chambers et al. | 510/154 |
| 6,376,439 | B2 | | 4/2002 | de Ferran et al. | 510/141 |

OTHER PUBLICATIONS

Photograph of Droyt's Clear Glycerine Soap, 100 g, Made in England.
Photograph of Claus Portco Vetyver Bath Soap, 12.3 oz., Made by Ach. Brito/ Lafco NY.
Photograph of Commonwealth Gardens Nourishing Celery Veggie Bath Soap, 9.7 oz., Manufactured by CST, Fall River, MA 02721.
Caswell-Massey, Co. Ltd. Early Spring 2004 Catalog.

* cited by examiner

SOAP BAR OR SUBSTANCE APPLICATION BAR

FIELD OF INVENTION

The present invention relates to a substance application bar that includes a blocking extension or a bar-preserving extension. It further relates to an assembly of application bars in stacked association.

BACKGROUND ART

Many different forms of application bars, such as soap bars, have been described in the prior art. A significant disadvantage associated with the prior art soap bars is that the surfaces of the soap bars are often extremely slippery and may be hard to grasp firmly with the hands. It can be very frustrating to have to search for and pick up the soap that has slipped from one's hand into the bath tub when one is bathing or showering. Furthermore, it is desirable that the soap bar can be grasped by the user in such a fashion that the user may manipulate the soap bar in a brushing fashion having the largest flat area of the soap placed in physical contact with the body surface to be lathered.

U.S. Pat. No. 4,618,443 discloses a soap bar structure which comprises an internal soap bar insert and an external scrub brush. The soap bar insert can be slid into the scrub brush by an interlocking groove. The scrub brush has a high outside surface friction which affords easy handling by the hands.

Two other examples which also employ a different material than soap include U.S. Pat. Nos. 4,741,852 and 6,190,079. Both patents teach a soap bar structure which contains a fabric or nylon portion to afford easy handling.

These structures all share some common disadvantages. First of all, the requirement of a second material in addition to soap adds to the difficulty and expense of manufacturing. Secondly, the additional material may not be resistant to the high temperature treatment entailed when the soap mixture is poured into the mold. Lastly, since an extraneous structure is included in the soap bar, it might fall off when a portion of the soap is inevitably eroded.

U.S. Pat. No. 5,071,583 discloses a soap bar comprising a projecting member which provides an aperture for receiving the user's fifth or little finger. This design has several disadvantages. Firstly, the irregular shape of the soap bar makes it more difficult to pack, transport and store. Secondly, this design puts too much strain on the little finger, which is of course, typically the smallest and weakest finger on someone's hand. Lastly, the addition of a projecting member off the soap bar makes it aesthetically less appealing to users.

Therefore, there remains a need for a substance application bar having a generally conventional cake form, but which is easily and stably held and manipulated by the user during bathing or showering.

Another well recognized disadvantage of soap bars is the deterioration which the soap undergoes when it is left in a soap holder. Water tends to remain on the cake soap or soap bar after use. If the soap is not dried quickly after it is put in a soap holder the surface of the soap will frequently soften and erode away. This results in undue waste and a much shorter lifespan of the cake soap or soap bar. The problem is even more acute when, for example, the container used to hold the soap does not have holes at the bottom to drain water that may be retained on the surface of the soap. Another factor that increases the waste occurs when a large area of the soap container's bottom touches the soap, thus preventing the ventilation and drying of the soap.

Numerous attempts have been made to reduce or eliminate this deterioration. Most of the prior attempts focus on the designing of a soap holder which would afford a small touching interface. One such example is a soap case with a ribbed bottom surface as taught by U.S. Pat. No. 5,509,529. Another extreme example of such an approach is an "X" shaped cord support of a soap bar wherein the bar is supported only by two lines.

Although these soap bar holders provide better ventilation, and thus faster drying of the soap bars, they may nevertheless shorten the lifespan of the soap by effecting a cut in the soap bar with the rib and the cords. Moreover, since all the above designs focus on the holder or case of the soap bars in order to preserve the soaps, they do not afford improvement in the soap bars themselves to achieve the preservation. The present invention eliminates the need for such specialized soap bar holders.

U.S. Pat. No. 4,335,007 does disclose an improvement of the soap bar itself in order to retard the deterioration of the soap bar from the bottom. In that patent, a base portion of the soap is made to be substantially water insoluble. The desired material for the water insoluble base portion may be plastics, metals, formed plastics and the like. One obvious disadvantage of this design is that when the soap is provided from a heated mixture into the mold, the material for the base portion might not be able to withstand the heat. The inclusion of another material in addition to the soap mixture will also raise the manufacturing cost of the soap bars.

Numerous patents have attempted to find other ways of preventing waste of soap by using the remaining fragments left of a soap bar. For example, U.S. Pat. No. 3,931,035 discloses a soap bar with a hollowed-out core. The core is filled with small remaining pieces of soap bars and a congealed mass of a soap solution. Similarly, U.S. Pat. No. 4,965,008 discloses a bar of soap having a recessed portion for receiving another used piece of soap. The used piece of soap may be adhered to a recessed portion of the bar by wetting the contact surface of the used piece of soap and the bottom surface of the recessed portion of the bar and depressing the used piece of soap into the recessed portion. U.S. Pat. No. 5,250,210 discloses a soap bar construction for incorporating partially used soap bars to avoid waste. These soap bars have a top cavity to accommodate a partially used soap bar or components thereof for reuse and remolding of the soap components. A modification of the invention includes an end cavity arranged for further receiving soap bar components and a cap member arranged to direct the components within the soap bar for reuse. The bar is not designed for easy handling and does not address the problem of waste associated with prolonged exposure to fluids.

Thus, there still remains a need for a substance application bar which has the advantage of preventing waste by minimizing contact between the substance application bar and fluids such as water. Preferably the feature is afforded by some structure that is an integral part of the substance application bar that does not employ another material that might be destroyed by heat.

Soap bar containers, soap dishes, and packaging for soap bars are also well-known in the art. U.S. Pat. No. 4,311,604 discloses a small soap bar embedded in the cavity of another, larger soap bar. The bottom of the cavity has an imprinted design, preferably having a raised design. As a result of the construction of this soap, it is possible to maintain the imprinted mark visible throughout the usage period of the soap bar even when the original imprinted mark on the surface of the smaller bar has already been washed or worn away.

U.S. Pat. No. 4,858,757 discloses a combined package and dish structure for a soap bar product. A box is dimensioned to permit the soap bar product to be fitted therein. A plurality of rods extend between two opposing sides of the box near the bottom. When the box is used as a package, the soap bar product is positioned in the box resting on the rods, and a covering is provided for the top of the box. When used as a soap dish, the box is inverted to permit the soap bar product to rest on top of the rods.

U.S. Pat. No. 5,941,376 discloses a container for a soap bar where the container is formed from first and second mating sections that are hollowed out to form a soap bar-receiving chamber when the sections are mated. The container is constructed to minimize the chances of a wet soap bar sticking to the walls of the chamber and to facilitate air flow through the chamber.

These containers have not satisfactorily solved the above-mentioned problems because they do not aid in the grasping of the soap bar. Moreover, they do not provide the versatility of an application bar that may act as packaging, soap dish or the soap itself.

SUMMARY OF THE INVENTION

The present invention relates to a substance application bar, which is typically designed to be easy to grasp firmly without slipping and to avoid waste due to prolonged exposure to liquids. The substance application bar preferably includes an application portion having an exterior surface and an interior surface, and is configured for applying a substance to a receiving surface and at least one blocking extension extending adjacent the interior surface of the application portion to define a retaining recess therebetween. The blocking extension and the interior surface are advantageously associated to cooperatively substantially block movement of an object received in the retaining recess in a direction generally along the interior surface against the blocking extension.

In one embodiment, the application portion of the bar is configured for applying a substance by friction. Typically, the substance will be soap. Furthermore, in a preferred embodiment the application portion, at least one blocking extension, or both are made of the substance. The substance may further include ingredients selected, for example, to exfoliate the skin or to perform other additional functions.

Advantageously, the object can be, for example, a bar of soap, sponge, washcloth, loofah, or one or more of a user's fingers. Preferably the object is one or more of a user's fingers or another bar of soap received in the recess.

In one non-limiting embodiment the at least one blocking extension includes a plurality of blocking extension segments spaced from each other and positioned for blocking the movement of the object. In yet another embodiment the application bar further includes at least one additional blocking extension extending adjacent the exterior surface of the application portion to define a retaining recess therebetween. In this embodiment the blocking extension and the exterior surface are associated to cooperatively substantially block movement of an object received in the retaining recess in a direction generally along the exterior surface against the additional blocking extension.

In a preferred embodiment, the at least one blocking extension comprises an upstanding wall. The wall may include a first portion disposed at an angle of about 75° to 120° with respect to the interior surface for blocking the movement of the object. The wall typically has an end portion in which the first portion is disposed. The height of the wall measured from the interior surface to the end portion is usually at least about ⅛ of an inch and less than about 2 inches.

The wall may include at least two upstanding walls disposed and configured for substantially blocking movement of the object in a plurality of directions against the walls. The upstanding walls may be disposed on opposite sides of the retaining recess for retaining the object laterally therebetween. The upstanding walls may also be spaced at less than about 5 inches. In a preferred embodiment, the recess is open on at least one end between the walls.

In another preferred embodiment, the upstanding walls are substantially parallel to each other. At least one additional upstanding parallel wall may be disposed adjacent to at least one of the upstanding walls defining a gap therebetween.

The present invention also relates to a substance application bar, which includes an application portion having an exterior surface and an interior surface made of a substance that can deteriorate when exposed to a fluid and configured for applying a substance to a receiving surface. The substance application bar also includes at least one bar-preserving extension extending adjacent the interior surface of the application portion to define an open recess therebetween. The bar-preserving extension and the recess are configured to maintain a portion of the recess open to the atmosphere to facilitate air flow through, and for drying of, the recess for resisting deterioration of the bar. In a preferred embodiment, the substance is soap. Typically, the application portion is made of the substance.

The present invention further relates to an assembly of substance application bars. The assembly includes at least two application bars in stacked association for blocking relative movement in at least one direction between the bars. At least two of the bars include an application portion having an exterior surface and an interior surface and configured for applying a substance to a receiving surface, and at least one extension extending adjacent the interior surface of the application portion to define a recess therebetween. At least one of the bars is in the stacked association with the extension of another of the bars.

At least one of the bars may also be in interjoined association with the extension of another of the bars. In this case, the recess of one of the at least two bars may be configured and dimensioned to interlockingly receive the extension of another of the at least two bars. In one embodiment, the bars are made of soap.

The at least two bars may further include first and second bars defining a cavity therebetween, and the bars may further comprise a third product received in the cavity in stacked association with the first and second bars. In a preferred embodiment, the third product is another bar. Furthermore, the cavity may be shaped to receive the product.

BRIEF DESCRIPTION OF THE DRAWINGS

Further features and advantages of the invention can be ascertained from the detailed description that is provided below in connection with the following drawing(s).

DETAILED DESCRIPTION OF THE PREFERRED EMBODIMENTS

The present invention relates to a substance application bar that overcomes the disadvantages of the soap bars of the prior art. The substance application bar of the present invention has the further advantage that the application bar is easy to grasp with the hands, thus preventing the bar from slipping when applying the bar to a receiving surface. Another potential advantage afforded by the present invention is that it inhibits the deterioration of the bar with bar-preserving extensions.

Figure 1:
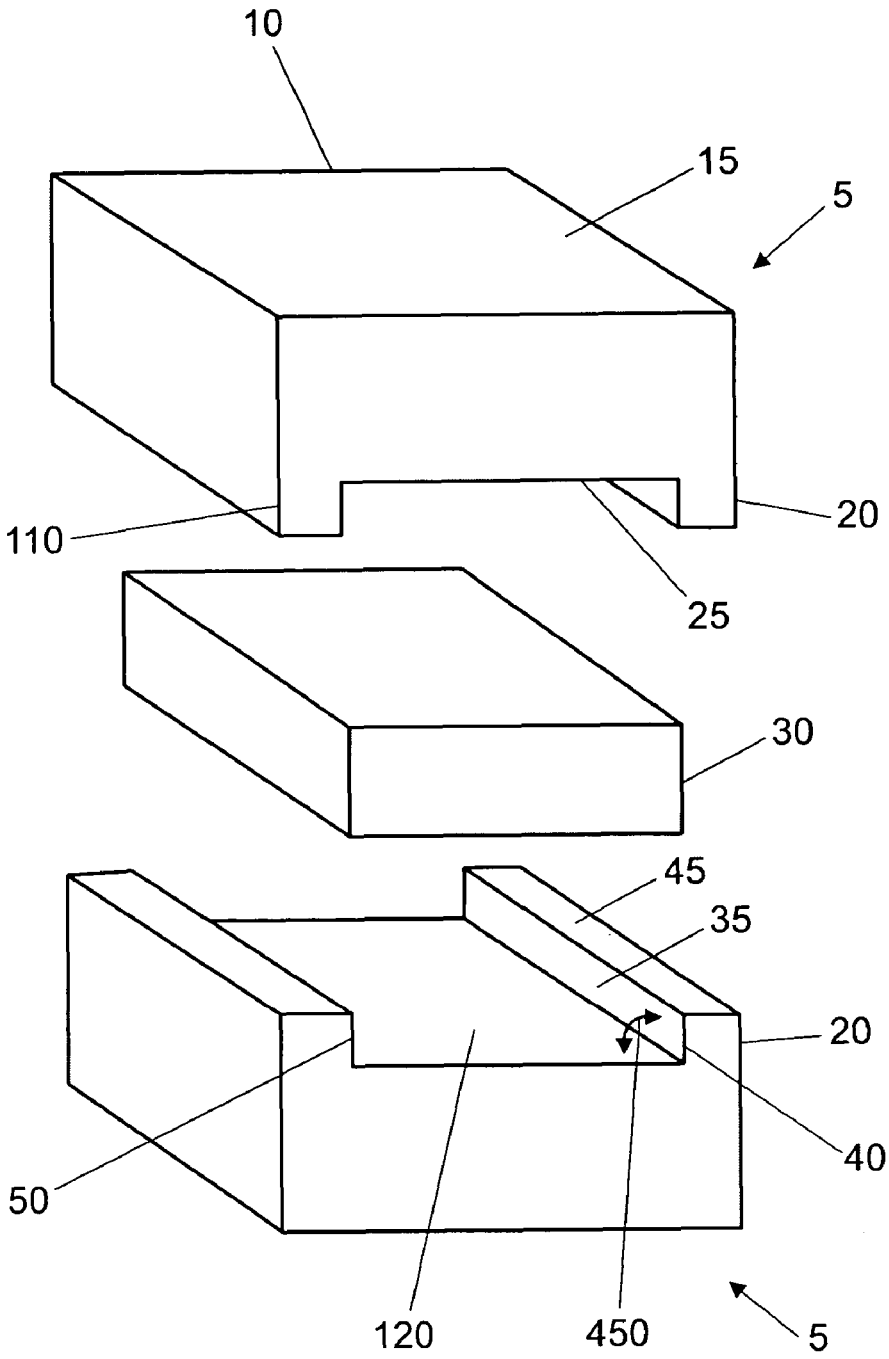
FIG. 1 illustrates a preferred embodiment of a substance application bar according to the present invention.

Referring to FIG. 1, the substance application bar 5 of the present invention includes an application portion 10 having an exterior surface 15 and an interior surface 120 and configured for applying a substance to a receiving surface and at least one blocking extension 20 extending adjacent the interior surface 120 of the application portion 10 to define a retaining recess 25 therebetween, the blocking extension 20 and the interior surface 120 being associated to cooperatively substantially block movement of an object 30 received in the retaining recess 25 in a direction generally along the interior surface 120 against the blocking extension 20. By "substantially block" is meant to stop, obstruct, or impede the passage of or movement of the object 30 along at least 25% of the distance along interior surface 120, preferably at least 10%. Moreover, the object 30 is preferably substantially the same shape and size as the retaining recess 25.

The application portion 10 is usually configured for applying the substance by friction, as when applying the substance directly to the receiving surface. The extensions 20, 110 of the application bar 5 of the present invention form a retaining recess 25 with which the hands can grasp the application bar 5.

Figure 2:
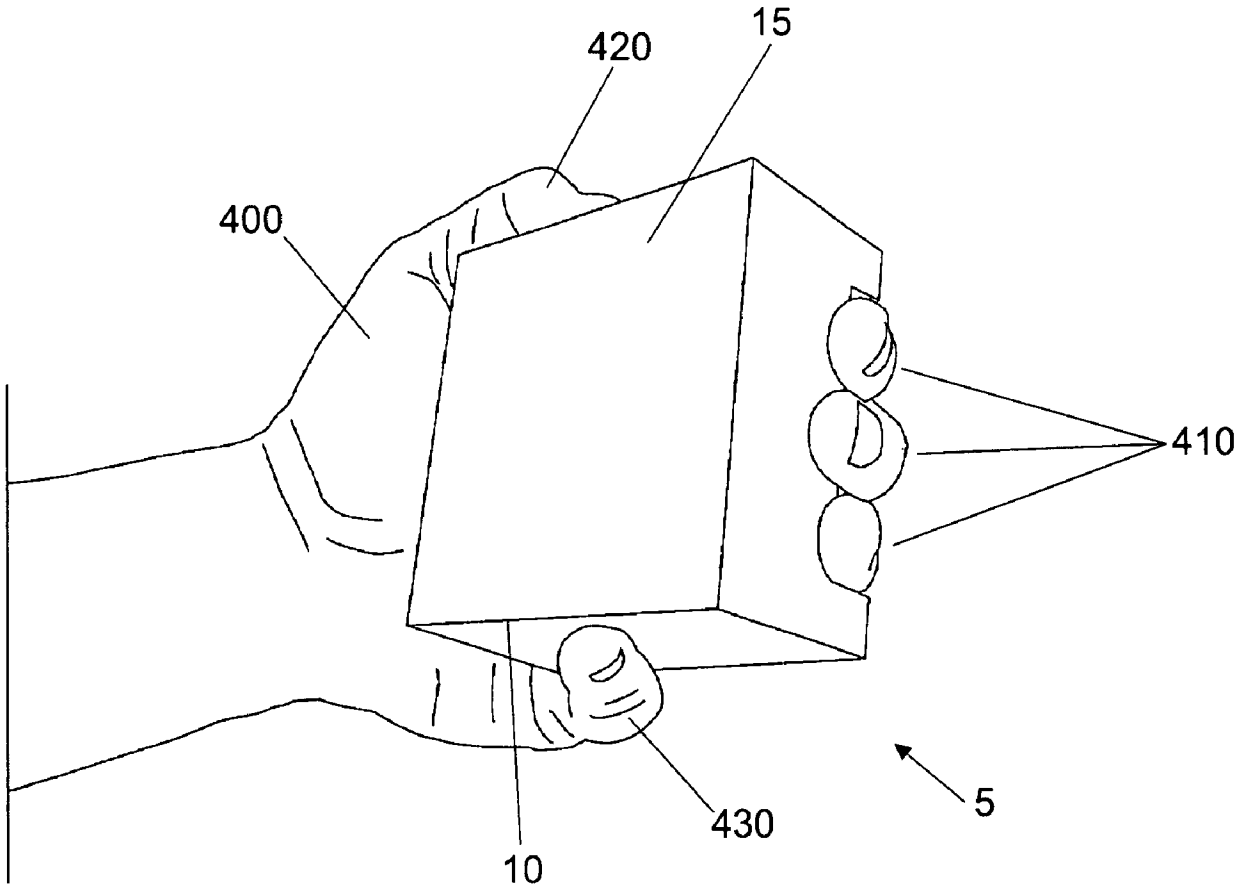
FIG. 2 illustrates a substance application bar according to the present invention where the object is a user's fingers.

Preferably, the object 30 is one or more of a user's fingers 410 as can be seen in FIG. 2. Typically, a user would grip the application bar 5 with his hand 400 such that his three middle fingers 410 fit easily into the retaining recess (not shown), while the thumb 420 and little finger 430 grip the outer edges. This point of positioning provides a control point which permits the user to manipulate the bar in a gripping fashion as well as provide a free and open area of the application portion 10 for contact with the receiving surface. An additional recess on one of the outer edges of the application bar (not shown) for the thumb 420 or little finger 430 may be included, but should be positioned in such a way that does not compromise the retaining recess.

In addition, the application portion may act as a container for the substance. In this case, the substance can be dispensed onto the application portion when the application bar is squeezed. Alternatively, the substance can be applied to the application portion.

Moreover, to facilitate easy application to the receiving surface, the application portion may be made of the substance. The blocking extension may also be made of the substance. The substance may be any substance that one usually applies to a surface, such as cosmetic formulations, cleaning substances, waxes or polishes. In a preferred embodiment, the substance to be applied is soap, and the application bar is made of the soap. Preferably, the soap contains glycerin or olive oil and does not contain any animal by-products. The soap may also contain ingredients selected to exfoliate the skin, such as, for example, walnut shells or beads.

Several non-limiting examples of soap combinations that can be used in the present invention include: (1) saponified (olive, castor, palm and coconut) oils, vegetable glycerin, soybean oil, essential oils, and FD&C color; (2) sodium cocoate, sodium palmate, *ricinus communis* (castor) seed oil, *carthamus tinctorius* (safflower) seed oil, glycerin, water, sorbitol, sorbitan oleate, and *glycine soja* (soybean) protein; (3) propylene glycol, sorbitol, glycerin, *olea europaea* (olive) fruit oil, sodium laureth sulfate, sodium stearate, sodium myristate, sodium cocoyl isethionate, triethanolamine, water, and aloe barbadensis leaf; (4) propylene glycol, sorbitol, glycerin, sodium laureth sulfate, sodium stearate, sodium myristate, sodium cocoyl isethionate, triethanolamine, and water; and (5) propylene glycol, sorbitol, glycerin, sodium laureth sulfate, sodium stearate, sodium myristate, sodium cocoyl isethionate, triethanolamine, water, and silica.

In FIG. 1, the object 30 is another bar of soap. Here, the application bar 5 may also function as a soap dish for the object 30. The application bar 5 may be disposed of when the bar of soap 30 has been used up, or may be retained for continued use.

Figure 3:
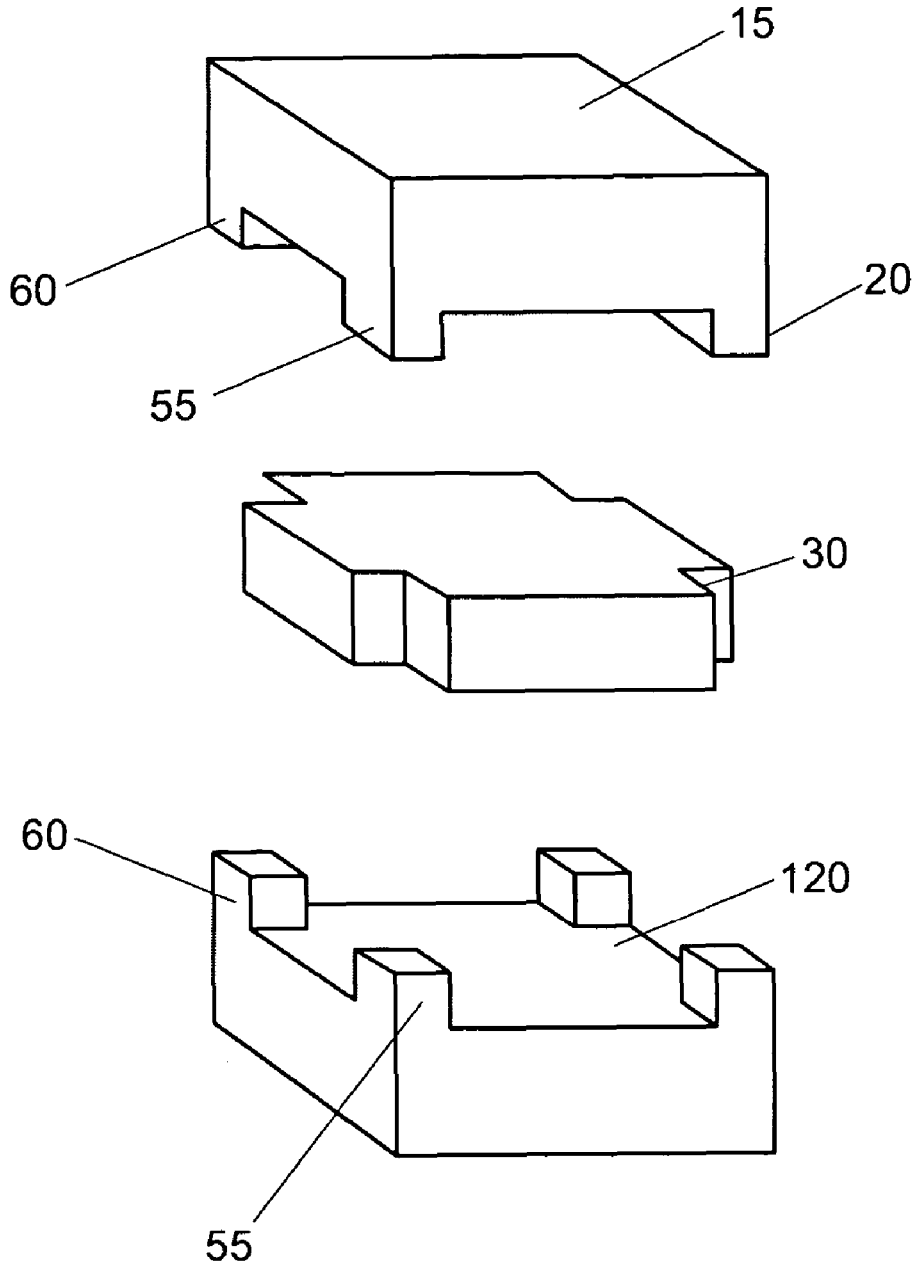
FIG. 3 illustrates a plurality of blocking extension segments of a substance application bar according to the present invention.

Referring to FIG. 3, the blocking extension 20 may include a plurality of blocking extension segments 55, 60 spaced from each other and positioned for blocking the movement of the object 30. The segments 55, 60 may be spaced from about 1 inch to about 5 inches apart, preferably from about 2 inches to about 4 inches, and more preferably from about 2 inches to about 3.5 inches. As can readily be seen, the object 30 is blocked from movement in two directions, i.e., along the x and y axis, against the interior surface 120.

Figure 4:
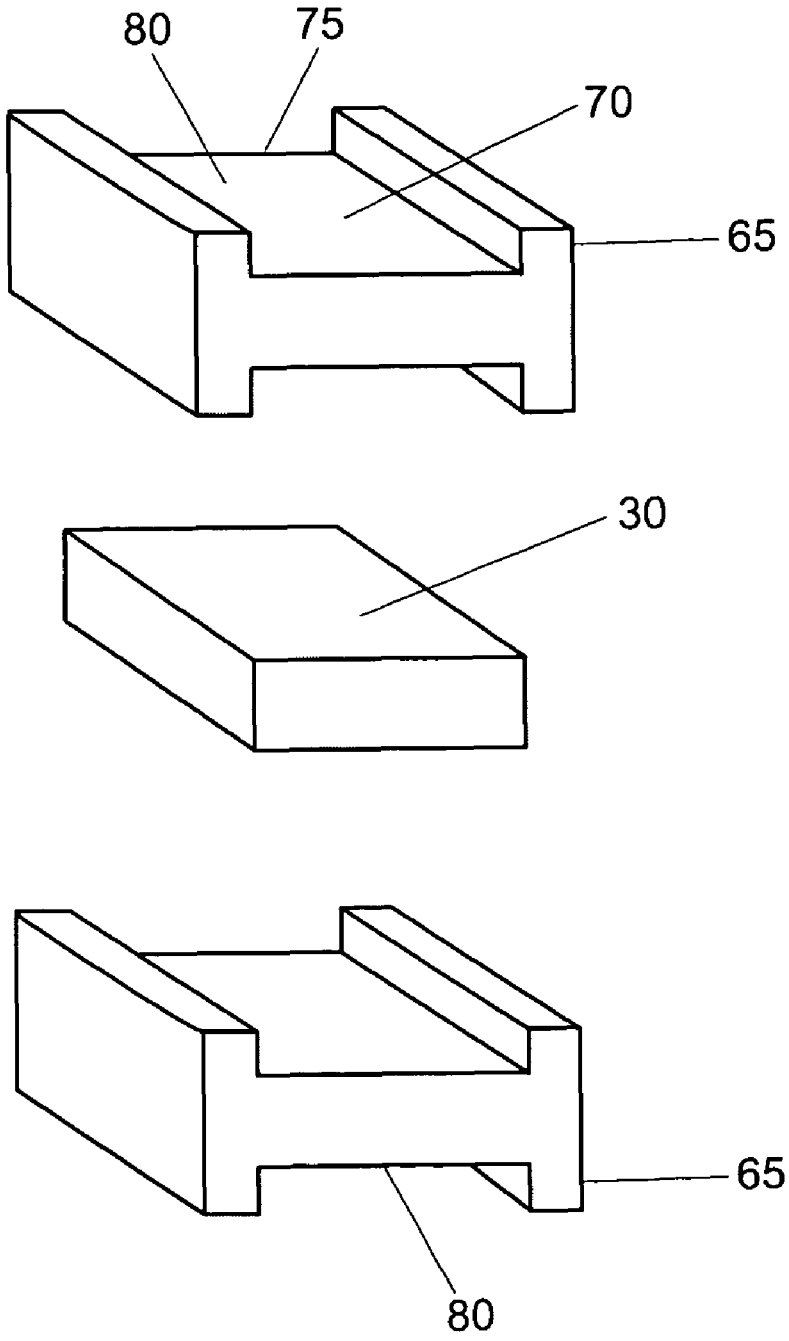
FIG. 4 illustrates an additional blocking extension of a substance application bar according to the present invention.

Referring to FIG. 4, at least one additional blocking extension 65 may extend adjacent to the exterior surface 70 of the application portion, the additional blocking extension 65 extending adjacent the exterior surface 70 of the application portion 75 to define a retaining recess 80 therebetween, the blocking extension 65 and the exterior surface 70 being associated to cooperatively substantially block movement of an object 30 received in the retaining recess 80 in a direction generally along the exterior surface 70 against the additional blocking extension 65. While this may not be ideal for direct application to the receiving surface, it may still be used. For example, when the application bar is made of soap, one using the bar may use both the exterior and interior surfaces of the application portion to soap up a washcloth. The washcloth with the soap can then by applied to the body.

Figure 5:
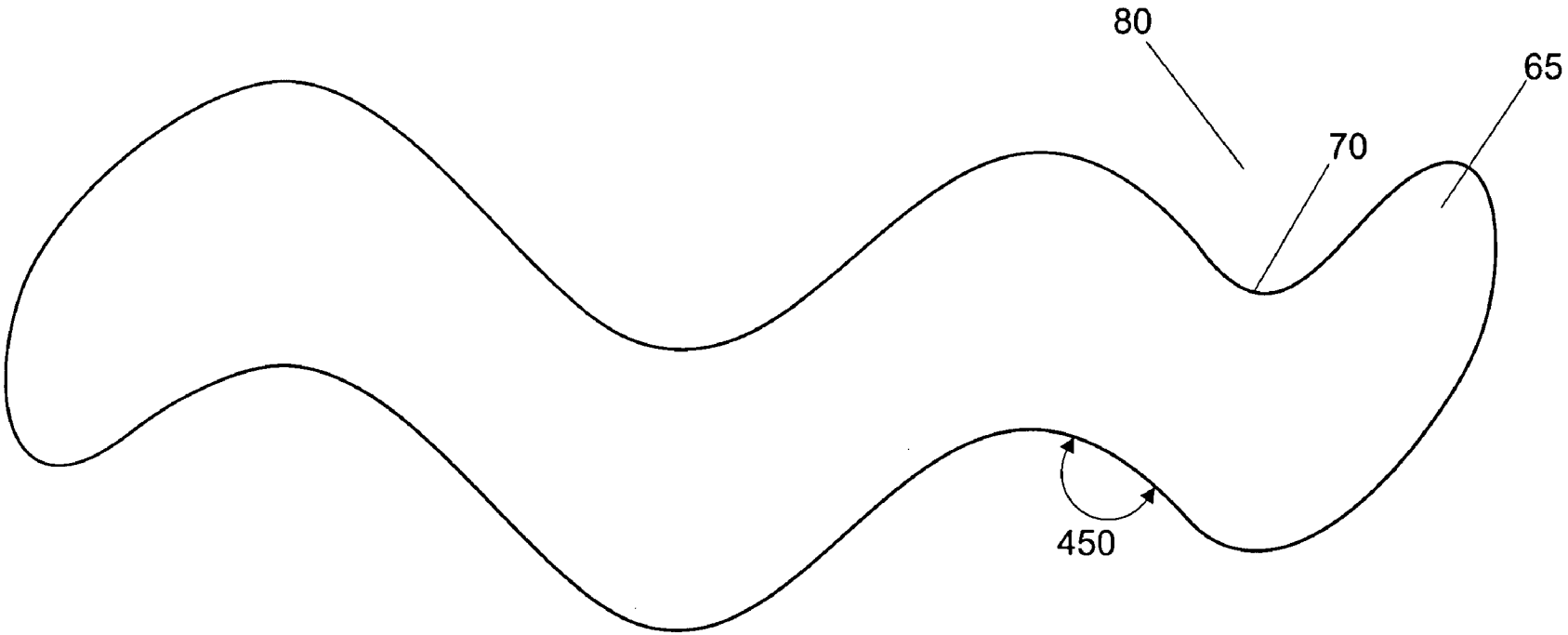
FIG. 5 illustrates one embodiment of a substance application bar with an additional blocking extension according to the present invention.
Figure 6:
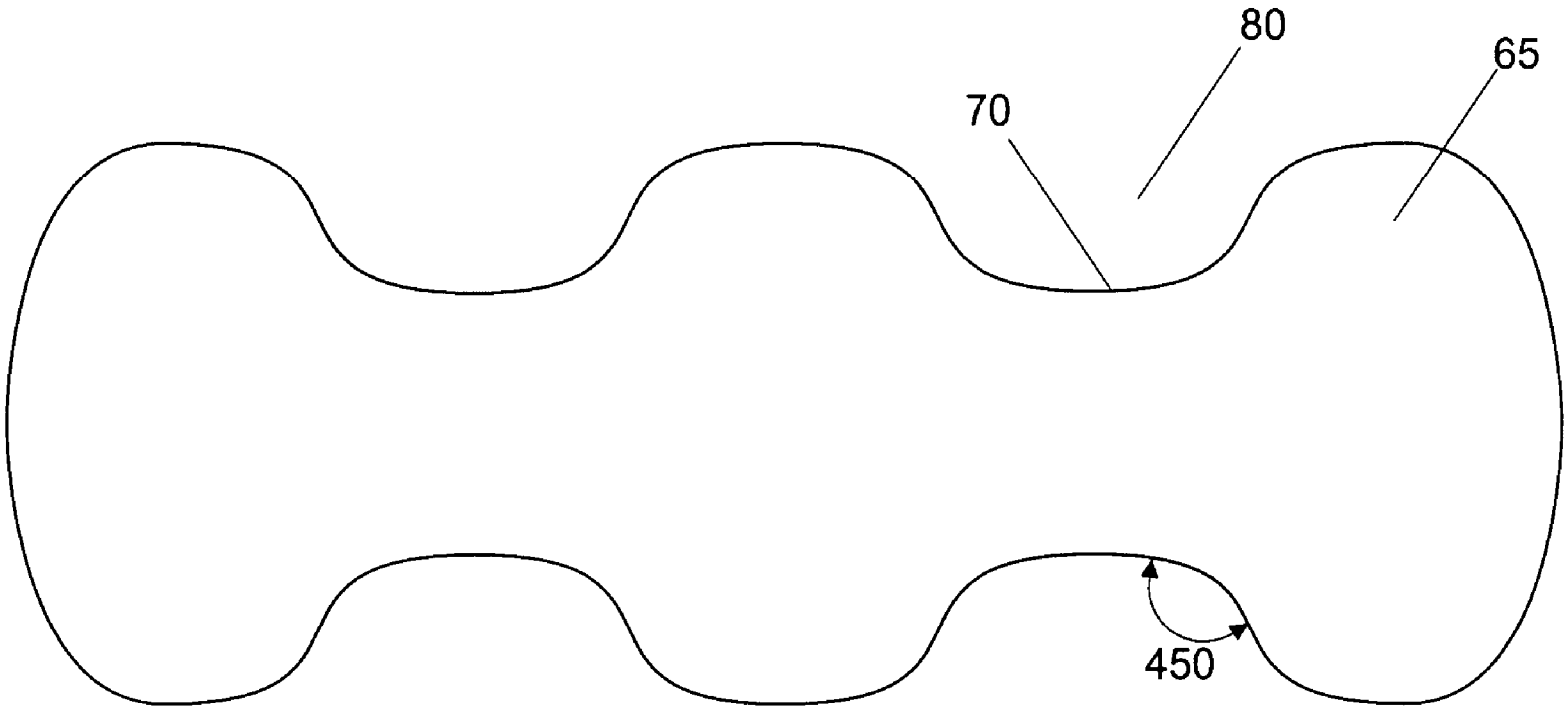
FIG. 6 illustrates another embodiment of a substance application bar with an additional blocking extension according to the present invention.

FIG. 5 and FIG. 6 illustrate other embodiments of the application bar with an additional blocking extension 65.

These embodiments further show that the edges of the application bar need not be straight, but may be curved.

In FIG. 1, the blocking extension 20 includes an upstanding wall 35. The wall 35 will typically include a first portion 40 disposed at an angle 450 of about 40° to 140°, more preferably of about 60° to 130° or about 75° to 120°, and most preferably of about 80° to 110° or about 90° to 105°, with respect to the interior surface 120 for blocking the movement of the object 30. In a preferred embodiment, the angle 450 is 90°. FIG. 5 and FIG. 6 show the angle 450 in embodiments of the application bar where the edges are curved.

The wall 35 in FIG. 1 usually includes an end portion 45 in which the first portion 40 is disposed. The height of the wall 35 measured from the interior surface 120 to the end portion 45 is at least about ⅛ of an inch and less than about 2 inches. In a preferred embodiment, the height of the wall 35 is about ⅜ of an inch, and in a more preferred embodiment, the height of the wall 35 is about ⅝ of an inch. The distance from the end portion 45 to the exterior surface 15 of the application portion of the bar is typically from about 1 inch to about 4 inches, preferably about 1¾ inches to about 3½ inches, most preferably from about 1½ inches to about 3 inches.

Generally, the wall 35 in FIG. 1 will include at least two upstanding walls 35, 50 disposed and configured for substantially blocking movement of the object 30 in a plurality of directions against the walls 35, 50. In one embodiment, the upstanding walls 35, 50 are disposed on opposite sides of the retaining recess 25 for retaining the object 30 laterally therebetween. The upstanding walls 35, 50 will usually be substantially parallel to each other. In addition, the upstanding walls 35, 50 may be spaced at less than about 5 inches, preferably spaced from about 1 inch to about 3½ inches apart, and more preferably spaced from about 1½ inches to about 2 inches apart. In addition, the upstanding walls 35, 50 may also be perpendicular to each other.

Figure 7:
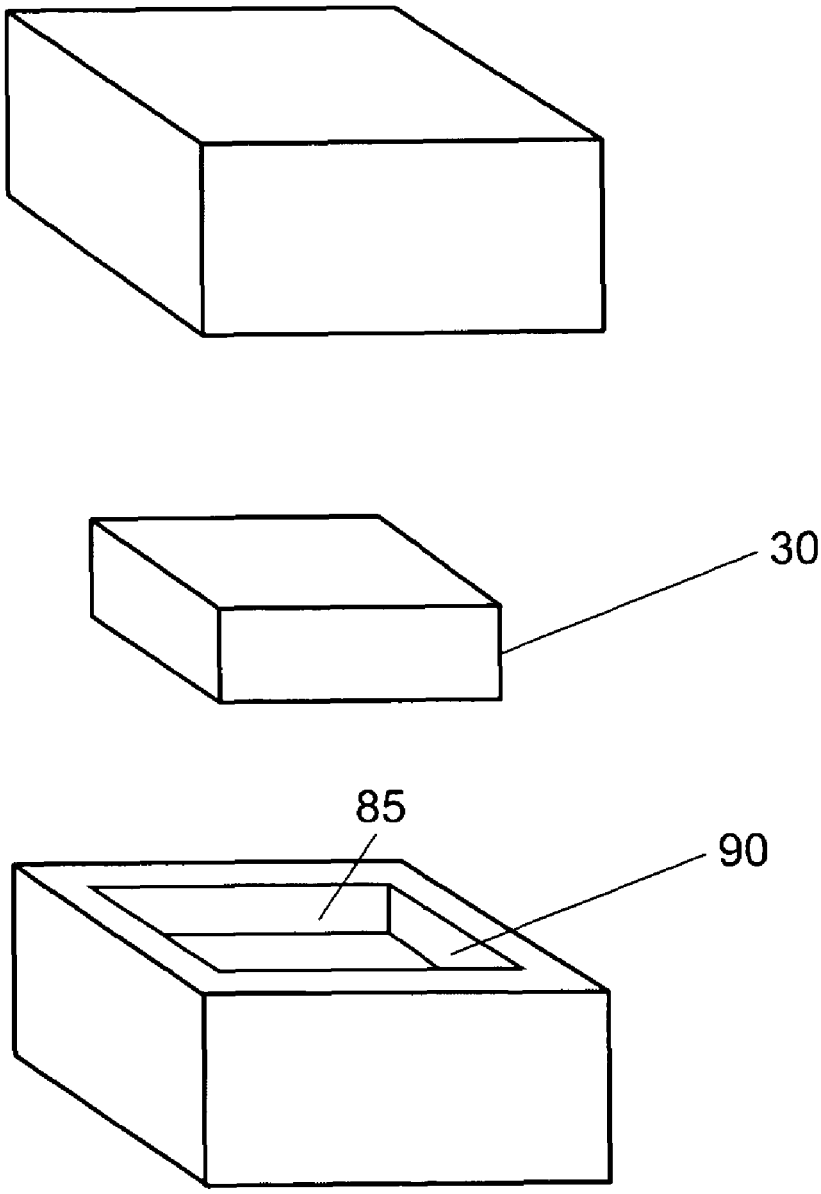
FIG. 7 illustrates a recess substantially surrounded by a blocking extension of a substance application bar according to the present invention.

Usually, the recess 25 remains open on at least one end between the walls 35, 50. It is possible, however, for the recess 85 to be substantially surrounded by the blocking extension 90 as can be seen in FIG. 7.

Figure 8:
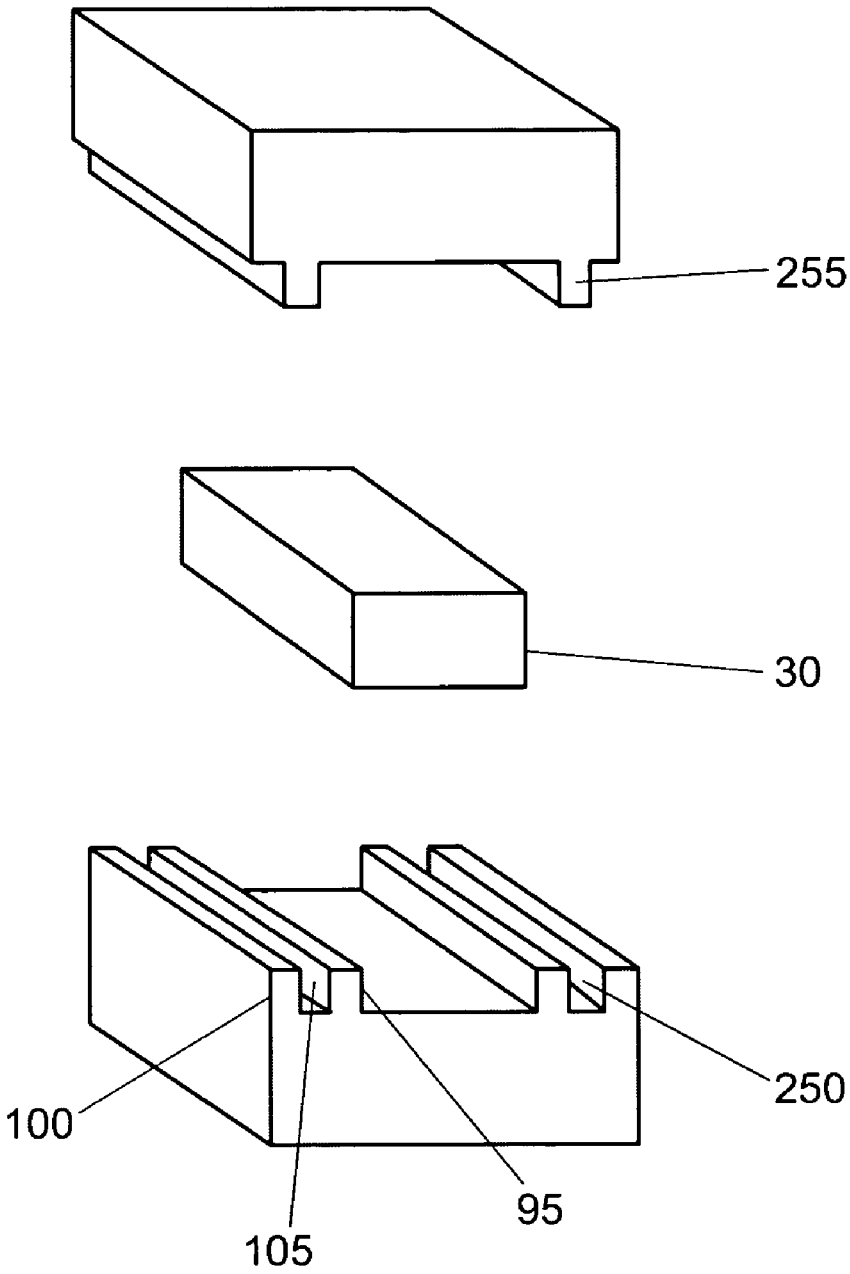
FIG. 8 illustrates an additional upstanding parallel wall of a substance application bar and an interlocking mechanism of an assembly of substance application bars according to the present invention.

Referring to FIG. 8, the application bar may further include at least one additional upstanding parallel wall 100 disposed adjacent to at least one of the upstanding walls 95 defining a gap 105 therebetween. This additional upstanding parallel wall 100 does not typically act as a blocking extension.

Additionally, FIG. 1 shows that the substance application bar 5 of the present invention may include an application portion 10 having an exterior surface 15 and an interior surface 120 made of a substance that can deteriorate when exposed to a fluid and configured for applying a substance to a receiving surface and at least one bar-preserving extension 20 extending adjacent the interior surface 120 of the application portion 10 to define an open recess 25 therebetween, the bar-preserving extension 20 and the recess 25 being configured to maintain a portion of the recess 25 open to the atmosphere to facilitate air flow through and for drying of the recess 25 for resisting deterioration of the bar 5.

The extensions 20, 110 in FIG. 1 are of sufficient length that the contact between the bar 5 and a bar holder in between uses is minimized. The length of the extensions 20, 110 measured from the interior surface 120 to the end of the extension 20 is at least about ⅛ of an inch and less than about 2 inches. In a preferred embodiment, the length of the extension is about ⅜ of an inch, and in a more preferred embodiment, the length of the extension is about ⅝ of an inch. As a result, any fluid that is transferred to the surface of the bar holder from the application bar after use does not touch the bar except for the extensions. This has the significant advantage of avoiding the erosion of that area of the application bar, and thus preserving the application bar. The extension of the lifespan of the application bar is also achieved by the fact that the extensions of the application bar provide an open recess between the application bar and the surface of the bar holder. This recess greatly facilitates the ventilation, and thus the drying of the surface of the application bar that does not touch the surface of the bar holder. The recess may act as a moisture hole, which acts to drain fluid away from the bar. This drying further reduces the erosion of the bar and extends its lifespan. In a preferred embodiment, the substance is soap, and the application portion is made of soap.

Figure 9:
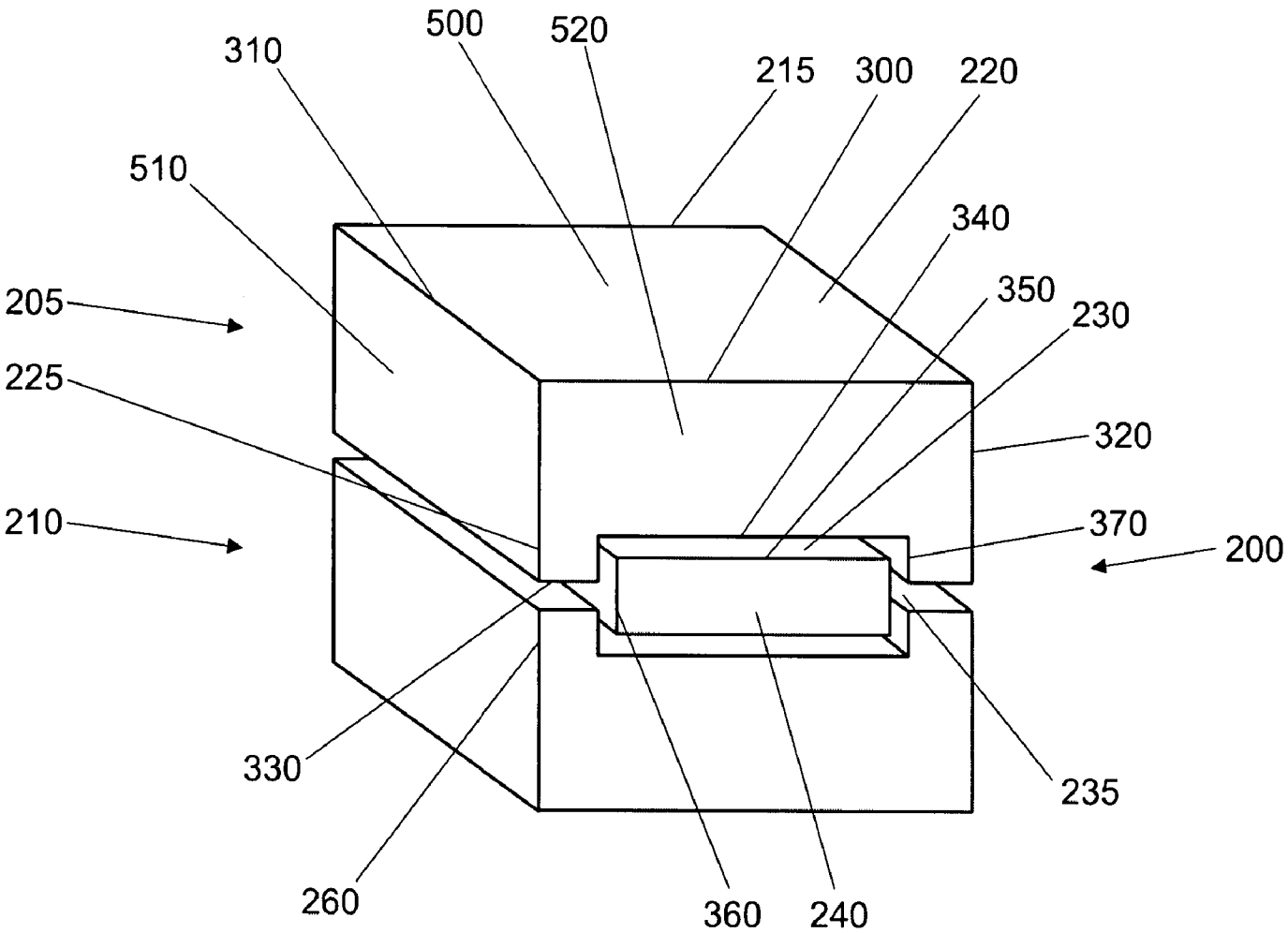
FIG. 9 illustrates a preferred embodiment of an assembly of substance application bars according to the present invention.

Referring to FIG. 9, the present invention also relates to an assembly of substance application bars 200, which include at least two application bars 205, 210 in stacked association for blocking relative movement in at least one direction between the bars where at least two of the bars include an application portion 215 having an exterior surface 220 and an interior surface (not shown) and configured for applying a substance to a receiving surface, and at least one extension 225 extending adjacent the interior surface of the application portion 215 to define a recess 230 therebetween, wherein at least one of the bars is in the stacked association with the extension 260 of another of the bars. By "stack" is meant to arrange in an orderly pile such that one bar is on top of the other.

One of the bars may also be in interjoined association with the extension of another bar. By "interjoin" is meant to unite into an integrated whole. Interjoining includes interlocking, hooking, dovetailing, and the like.

Figure 10:
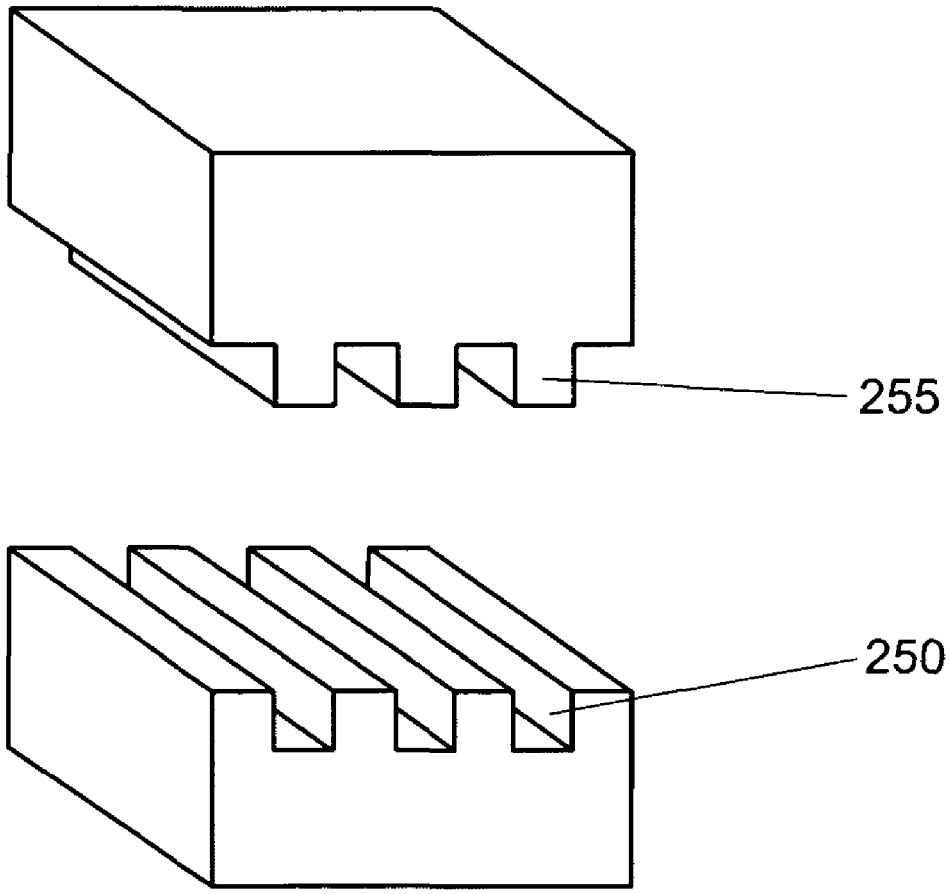
FIG. 10 illustrates an interlocking mechanism of an assembly of substance application bars according to the present invention.
Figure 11:
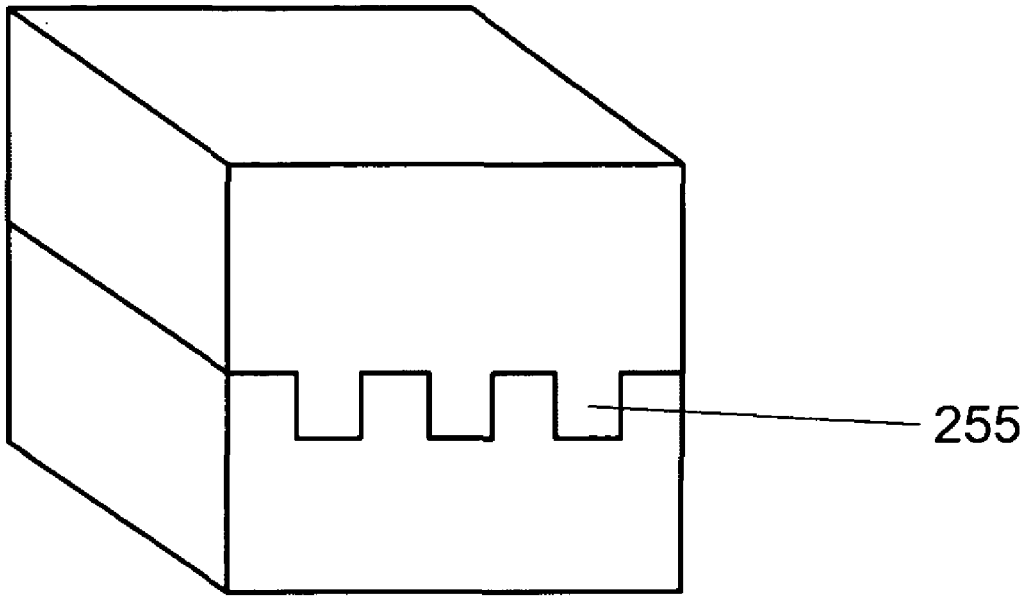
FIG. 11 illustrates an assembly formed by the interlocking mechanism of an assembly of substance application bars according to the present invention.

Referring to both FIG. 8 and FIG. 10, one can see that the recess 250 of one of the at least two bars can be configured and dimensioned to interlockingly receive the extension 255 of another of the at least two bars. FIG. 11 shows that the two bars in FIG. 10 interlock to form a single piece.

In FIG. 9, the at least two bars include first and second bars 205, 210 defining a cavity 235 therebetween, and the bars further comprise a third product 240 received in the cavity 235 in stacked association with the first and second bars 205, 210. In a preferred embodiment, the product 240 is a third bar, and the cavity 235 is preferably shaped to receive the bar. The product received in the cavity is not limited to bars. Acceptable products include other bath products, such as washcloths, shampoos, conditioners, bath beads, bath oil, body wash, sponges, loofahs, brushes, bubble bath, bath softgels, bath oils, bath lotions, bath salts, body lotions, body mists, massage oils, shower gels, exfoliators, spa accessories, and the like. Any product, though not associated with the bath, may also be received in the cavity, such as candles, cosmetic products, or air fresheners. The products are preferably shaped to fit snugly into the cavity to prevent them from sliding out. Most preferably, the products to be placed in the cavity are similar in shape and size to the cavity. The cavity is usually rectangular or round in shape, but may be shaped in any convenient way to hold an additional product.

The assembly may further be used to package the product. In a preferred embodiment, the assembly will be rectangular in shape to provide for efficient storage. When the bars are made of soap, parts of the assembly may be used as a soap dish or as the soap itself. This minimizes consumer waste, which is an ever increasing problem. Moreover, this type of packaging allows as many parts of the invention to be reused and recycled as possible, and thus prevents the waste of material.

The individual bars of the assembly may be separately wrapped or the assembly may be wrapped as a whole. They may be wrapped in any kind of packaging material usually used to wrap application bars or other beauty products, such as plastics or paper. Additional packaging, such as a box of sufficient size to hold the assembly, may be used to hold the entire assembly. When this is the case, supplementary products may be included in the box, such as sponges, soap dishes or other products.

It should be understood that the term "application bar" as used herein is intended to include not only rectangular bars, as shown, but bars of various shapes known in the art, such as disk-shaped or circular bars. Moreover, the term "about," as used herein, should generally be understood to refer to both numbers in a range of numerals. Moreover, all numerical ranges herein should be understood to include each whole integer within the range.

Numerous modifications and changes will be readily evident to those skilled in the art. It is therefore understood that this invention is not limited to the specific embodiments disclosed. Accordingly, all expedient modifications readily attainable by one of ordinary skill in the art from the disclosure set forth herein, or by routine experimentation therefrom, are deemed to be within the spirit and scope of the invention as defined by the appended claims.

EXAMPLE

The following example is not intended to limit the scope of the invention, but merely to illustrate representative possibilities concerning the present invention.

Example 1

An Assembly of Substance Application Bars According to the Invention

The accompanying FIG. 9 illustrates an exemplary assembly of substance application bars constructed according to the present invention. Substance application bars 205, 210 were formed from a combination of saponified (olive, castor, palm and coconut) oils, vegetable glycerin, soybean oil, essential oils, and FD&C color. Edges 300 and 310 define surface 500 of application bar 205. Surface 500 was made to measure about 3 inches in length and 3 inches in width. Edges 300, 320, 330, 340, and 370 define surface 520. Edge 300 was made to measure about 3 inches in length. Edge 320 was made to measure about 1 7/16 inches, making the whole assembly about 2 7/8 inches in height. Edge 330 was made to measure about 3/8 of an inch in length, while edge 340 was made to measure about 2 1/4 inches in length. Edge 370 was made to measure about 1 inch in height. The bar 240 was formed from a combination of saponified (olive, castor, palm and coconut) oils, vegetable glycerin, soybean oil, essential oils, and FD&C color. The bar 240 was made to have edge 350, which measured about 2 1/8 inches in length, and edge 360, which measured about 7/8 of an inch in height.

What is claimed is:

1. A substance application bar, comprising:

an application portion having an exterior surface and an interior surface and configured for applying a substance to a receiving surface; and at least one blocking extension extending adjacent the interior surface of the application portion to define a retaining recess therebetween, the blocking extension comprising at least two upstanding walls adjacent to each other and spaced from about 1 inch to about 3 1/2 inches apart, and the blocking extension and the interior surface being associated to cooperatively substantially block movement of an object received in the retaining recess in a direction generally along the interior surface against the blocking extension, wherein the recess is open on the lateral end between the walls.

2. The application bar of claim 1, wherein the application portion is configured for applying the substance by friction.

3. The application bar of claim 1, wherein the object is one or more of a user's fingers.

4. The application bar of claim 1, wherein the application portion is made of the substance.

5. The application bar of claim 4, wherein the at least one blocking extension is made of the substance.

6. The application bar of claim 4, wherein the substance is soap.

7. The application bar of claim 6, wherein the substance further comprises ingredients selected to exfoliate the skin.

8. The application bar of claim 6, wherein the object is another bar of soap.

9. The application bar of claim 1, wherein the at least one blocking extension comprises a plurality of blocking extension segments spaced from each other and positioned for blocking the movement of the object.

10. The application bar of claim 1, further comprising at least one additional blocking extension extending adjacent the exterior surface of the application portion to define a retaining recess therebetween, the blocking extension and the exterior surface being associated to cooperatively substantially block movement of an object received in the retaining recess in a direction generally along the exterior surface against the additional blocking extension.

11. The application bar of claim 1, wherein at least one wall comprises a first portion disposed at an angle of about 75° to 120° with respect to the interior surface for blocking the movement of the object.

12. The application bar of claim 11, wherein the wall has an end portion in which the first portion is disposed.

13. The application bar of claim 12, wherein the height of the wall measured from the interior surface to the end portion is at least about 1/8 of an inch and less than about 2 inches.

14. The application bar of claim 11, wherein the walls are disposed and configured for substantially blocking movement of the object in a plurality of directions against the walls.

15. The application bar of claim 14, wherein the walls are disposed on opposite sides of the retaining recess for retaining the object laterally therebetween.

16. The application bar of claim 15, wherein the walls are spaced from about 1 1/2 inches to about 2 inches apart.

17. The application bar of claim 14, wherein the walls are substantially parallel to each other.

18. The application bar of claim 17, further comprising at least one additional upstanding parallel wall disposed adjacent to at least one of the upstanding walls defining a gap therebetween.

19. A substance application bar, comprising:

an application portion having an exterior surface and an interior surface made of a substance that can deteriorate when exposed to a fluid and configured for applying a substance to a receiving surface; and at least one bar-preserving extension extending adjacent the interior surface of the application portion to define an open recess therebetween, the bar-preserving extension comprising at least two upstanding walls adjacent to each other and spaced from about 1 inch to about 3 1/2 inches apart, and the bar-preserving extension and the recess being configured to maintain a portion of the recess open to the atmosphere to facilitate air flow through and for drying of the recess for resisting deterioration of the bar, wherein the recess is open on the lateral end between the walls.

20. The application bar of claim 19, wherein the substance is soap.

21. The application bar of claim 19, wherein the application portion is made of the substance.

22. An assembly of substance application bars, comprising:

at least two application bars in stacked association for blocking relative movement in at least one direction between the bars, at least two of the bars comprising:

an application portion having an exterior surface and an interior surface and configured for applying a substance to a receiving surface, and at least one extension extending adjacent the interior surface of the application portion to define a recess therebetween, the extension comprising at least two upstanding walls adjacent to each other and spaced from about 1 inch to about 3½ inches apart, and the recess being open on the lateral end between the walls;

wherein at least one of the bars is in the stacked association with the extension of another of the bars.

23. The assembly of claim 22, wherein the bars are made of soap.

24. The assembly of claim 22, wherein at least one of the bars is in interjoined association with the extension of another of the bars.

25. The assembly of claim 24, wherein the recess of one of the at least two bars is configured and dimensioned to interlockingly receive the extension of another of the at least two bars.

26. The assembly of claim 22, wherein the at least two bars comprise first and second bars defining a cavity therebetween, and the bars further comprise a third product received in the cavity in stacked association with the first and second bars.

27. The assembly of claim 26, wherein the third product is another bar.

28. The assembly of claim 26, wherein the cavity is shaped to receive the product.

* * * * *